US005457521A

United States Patent [19]

Makiura et al.

[11] Patent Number: 5,457,521

[45] Date of Patent: Oct. 10, 1995

[54] IMAGE FORMING APPARATUS WITH ISOLATED SILICONE GAS

[75] Inventors: Takashi Makiura; Shinichi Azumi; Hiroaki Yoshida; Toyokazu Mori, all of Yamatokoriyama; Yoshinobu Tateishi, Shiki; Mitsuyoshi Terada, Nara, all of Japan

[73] Assignee: Sharp Kabushiki Kaisha, Osaka, Japan

[21] Appl. No.: 226,643

[22] Filed: Apr. 12, 1994

[30] Foreign Application Priority Data

Apr. 16, 1993 [JP] Japan ..... 5-089644

[51] Int. Cl.[6] ..... G03G 21/00

[52] U.S. Cl. ..... 355/215

[58] Field of Search ..... 355/215, 30, 210; 361/521; 174/16.1

[56] References Cited

U.S. PATENT DOCUMENTS 4,540,268 9/1985 Toyono ..... 355/210
5,038,174 8/1991 Kato et al. ..... 355/215
5,081,496 1/1992 Takeda ..... 355/215
5,291,247 3/1994 Dececca ..... 355/215

FOREIGN PATENT DOCUMENTS 3-61942 9/1991 Japan .

*Primary Examiner*—R. L. Moses
*Attorney, Agent, or Firm*—David G. Conlin; Kevin J. Fournier

[57] ABSTRACT

An object of the invention is to prevent a silicone gas generated in a fixing unit from entering into a charger. A corona wind rises when the charger corona-discharges, and air is taken in through an outside-air intake. The air flows in through the air passage and the air inlet and flows out through a front opening as an air flow. The silicone gas is isolated by the airflow and prevented from entering into the charger.

8 Claims, 9 Drawing Sheets

IMAGE FORMING APPARATUS WITH ISOLATED SILICONE GAS

BACKGROUND OF THE INVENTION

1. Field of the Invention

The present invention relates to an electrophotographic type image forming apparatus such as a laser printer, a plain paper copier, and a plain paper facsimile, particularly to a mechanism in which silicone gas generated in a fixing unit does not affect a charger.

2. Description of the Related Art

FIG. 10 shows an entire constitution of a conventional laser printer. As shown in FIG. 10, a printer body 1 comprises an optical unit 2 provided with a semiconductor laser device 3 and a mirror 4, a process unit 5 into which a photosensitive body 6, a charger 7 and a cleaning device 8 are integrated, a developing unit 9 into which a toner box 10 is integrated, a fixing unit 11, a transfer unit 12, a sheet feeding cassette 13, a sheet storage portion 14, a sheet hopper 15, a pick-up roller 16, a sheet conveying path 17, a manually sheet-feeding portion 18, a sheet carrying roller 19, a registration roller 20, a sheet conveying roller 21, a sheet discharging roller 22, and a face-down tray 23.

A discharge electrode 25 (charger wire or acicular electrode) is arranged in a case body 24 of the charger 7 as shown in FIG. 11, to provide electrostatic charges on a surface of the photosensitive body 6 by corona discharge to electrify the surface. At that time, a corona wind (air flow) rises in the charger 7. More specifically, a negative electron moves from the discharge electrode 25 (charger wire) o an opposed electrode (the case body) by corona discharge, and at that time, an air flow, so-called corona wind is caused on the process that the air between the electrodes is ionized.

The fixing unit 11 is provided with an upper heat roller 27 and a lower pressure roller 28 made of silicone rubber which are rotatably supported by the main body 26 of the fixing unit 11.

Further, the upper heat roller 27 is in contact with a cleaning roller (not shown) impregnated with silicone oil in order to prevent the upper heat roller 27 from being contaminated by toner. The surface temperature of the respective rollers 27, 28 is maintained high by heater lamps arranged for the respective rollers 27, 28 in order to fix the toner on a sheet. In view of the separability (degree of separability of the molten toner from the surface of the heat roller) of the actually available toner, a separating agent such as silicone oil is necessary for separating the residue of the molten toner from the heat roller. If the separating agent is not used, a problem arises that the residue of the molten toner on the heat roller contaminates the top of a sheet on the following rotation of the heat roller, and additionally contaminates the surface of the opposed pressure roller, resulting in the contamination of the back of the sheet.

A silicone gas with a low molecular weight is generated in a conventional laser printer, because the silicone rubber of the pressure roller 28 and the silicone oil in the fixing unit 11 are vaporized due to the high temperature. The silicone gas is moved toward a direction of arrow B shown in FIG. 11 by a fan (not shown) in the printer body 1, so that the charger 7 is wrapped round by the silicone gas. Moreover, since the printer body 1 is not provided with a dedicated air passage, air flow A is generated which is introduced into the charger 7 and discharged therefrom due to a corona wind on discharging and a light wind by the rotation of the photosensitive body 6, and the silicone gas is involved into the air flow with the peripheral air.

Accordingly, positive ion molecules of a low molecular siloxane contained in the silicone gas are drawn to the discharge electrode (charger wire 25) to which a high voltage is applied, and the low molecular siloxane contained in the silicone gas is deposited on the tip portion etc. of the electrodes, which causes abnormal discharge. As a result, the photosensitive body 6 is ununiformly electrified, which has a bad influence on the image quality.

The constitution that the generated silicone gas is directly exhausted to the outside or that the generated silicone gas is isolated so as to be prevented from entering into the side of the charger 7 is difficult to be realized because the complexity of the internal structure thereof. Besides, the necessity of providing with a fan causes an increase in cost.

Further, it is necessary to clean the discharge electrode 25 early, because the abnormal discharge occurs in the relatively short period of service (10,000 to 15,000 sheets copied).

SUMMARY OF THE INVENTION

Accordingly, it is an object of the invention to provide an image forming apparatus which can prevent the silicone gas from entering into the charger and maintain stable electrification for a long service period.

Means for solving the problem according to the invention is, as shown in FIG. 1, an image forming apparatus in a body of which a charger 34 for electrification of a photosensitive body 33 is provided in such arrangement that a front opening 45 of the charger 34 is opposed to the photosensitive body 33 and which comprises an outside-air intake 52 being formed in the image forming apparatus body 30, an air inlet 53 being formed in the charger 34 and an air passage 54 communicating between the air inlet 53 and the outside-air intake 52.

Means for solving the problem according to the invention is an image forming apparatus wherein a photosensitive cartridge 32 provided with the photosensitive body 33 and the charger 34 is disconnectably installed in the image forming apparatus body 30 and the air passage 54 is formed in the photosensitive cartridge 32.

Means for solving the problem according to the invention is an image forming apparatus wherein the air passage 54 is formed by utilizing a side wall 56 of the photosensitive cartridge 32 in a longitudinal direction.

Means for solving the problem according to the invention is an image forming apparatus wherein the outside-air intake 52 is formed on a top face 44 of the photosensitive cartridge 32.

Means for solving the problem according to the invention is an image forming apparatus wherein the outside-air intake 52 is arranged apart from a fixing unit 42.

In the means for solving the problem according to the invention, a corona wind rises when electrostatic charges are provided on the surface of the photosensitive body 33 by virtue of corona discharge of the charger 34 to electrify the surface of the photosensitive body 33. Due to the corona discharge, air is taken in through the outside-air intake 52. The air flows in through the air passage 54 and the air inlet 53 and blows out through the front opening 45 as an airflow 57. Since a flow direction of the silicone gas generated in the fixing unit 42 is forcedly changed due to the air flow 57, the air flow 57 is prevented from flowing into the charger 34.

In the means for solving the problem according to the invention, the air passage 54 can be integratedly formed by utilizing the cartridge side wall 56 in the photosensitive cartridge 32.

In the means for solving the problem according to the invention, the outside-air intake 52 is arranged on the top face 44 of the photosensitive cartridge 32 and apart from the fixing unit 42, which makes it possible to control the inflow of the silicone gas into the charger 34 to the minimum.

As described above, according to the invention, since air is taken in through the outside-airintake and flows out through the front opening of the charger, the silicone gas generated in the fixing unit can be prevented from flowing into the charger. Consequently, the abnormal discharge of the charger caused by the silicone gas can be avoided and a high quality of image is obtainable for a long service period. Furthermore, according to the invention, it is unnecessary to clean the charger for a long service period. As a result, the frequency of maintenance service can be reduced and the handling is improved.

According to the invention, since the air passage is integratedly formed in the photosensitive cartridge, it is possible to make the photosensitive cartridge smaller in size and lighter in weight. Consequently, cleaning the charger is unnecessary for a long service period and therefore it is possible to provide an image forming apparatus of easy handling.

According to the invention, the outside-air intake is arranged on the top face of the photosensitive cartridge, apart from the fixing unit, which makes it possible to control the inflow of the silicone gas into the charger to the minimum and to prevent the abnormal discharge caused by the silicone gas.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
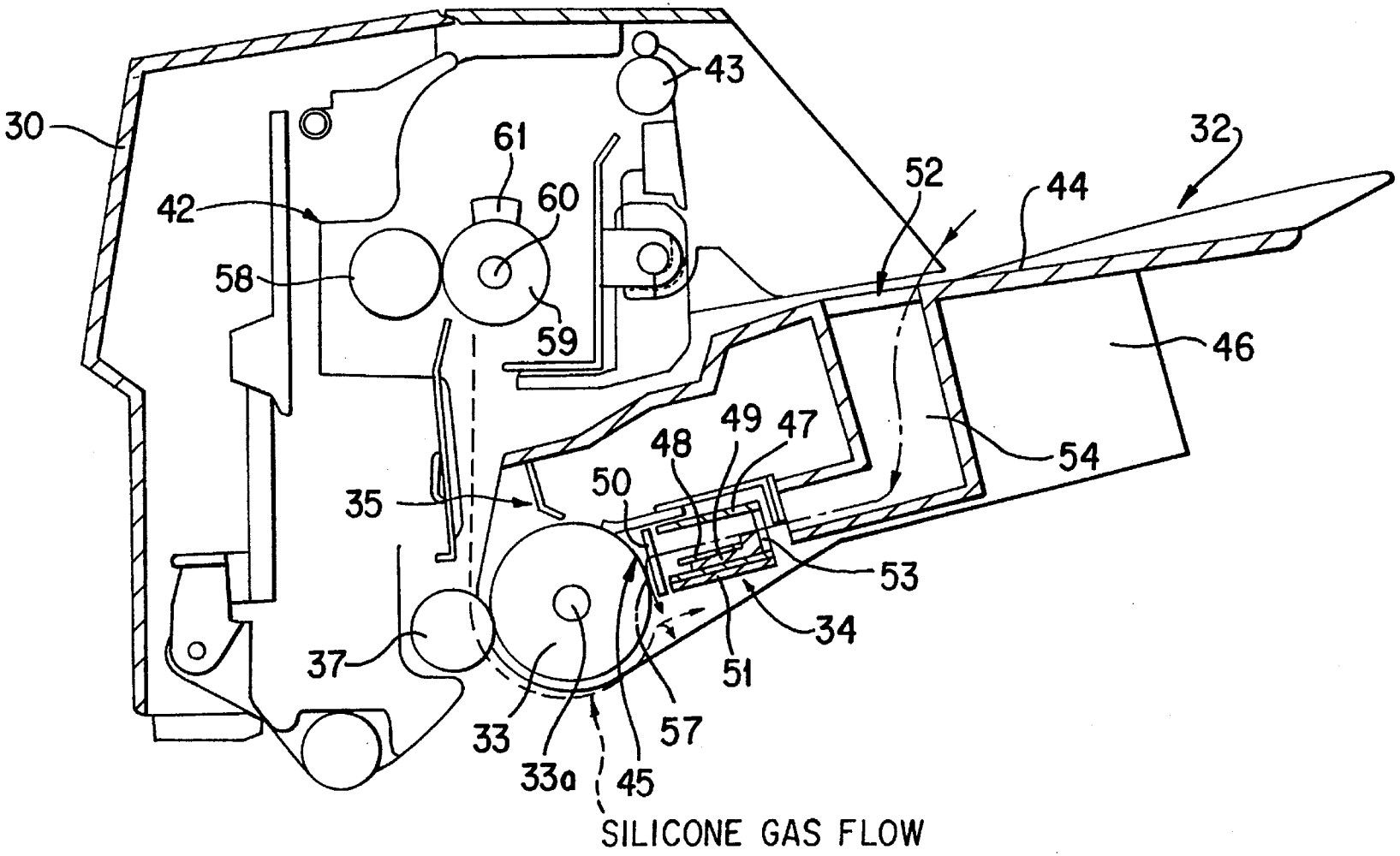
FIG. 1 is a view showing a constitution of main parts of an embodiment of a laser printer according to the invention.

Now referring to the drawings, preferred embodiments of the invention are described below.

Figure 2:
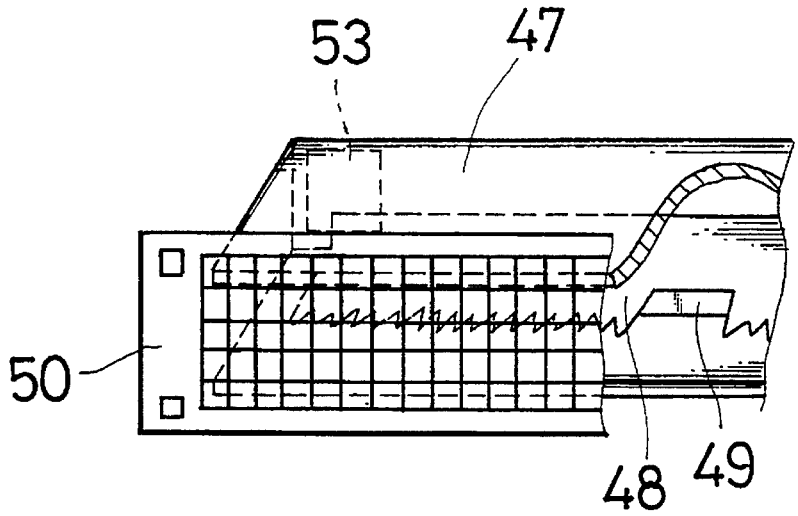
FIG. 2 is a perspective view of a charger.
Figure 3:
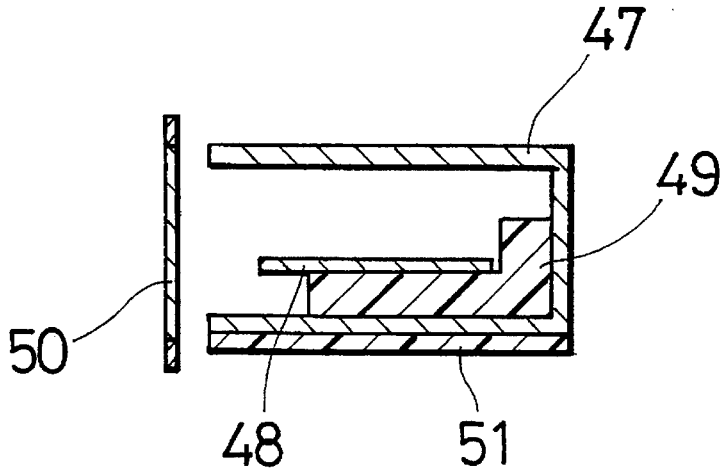
FIG. 3 is an enlarged sectional view of the charger shown in FIG. 2.
Figure 4:
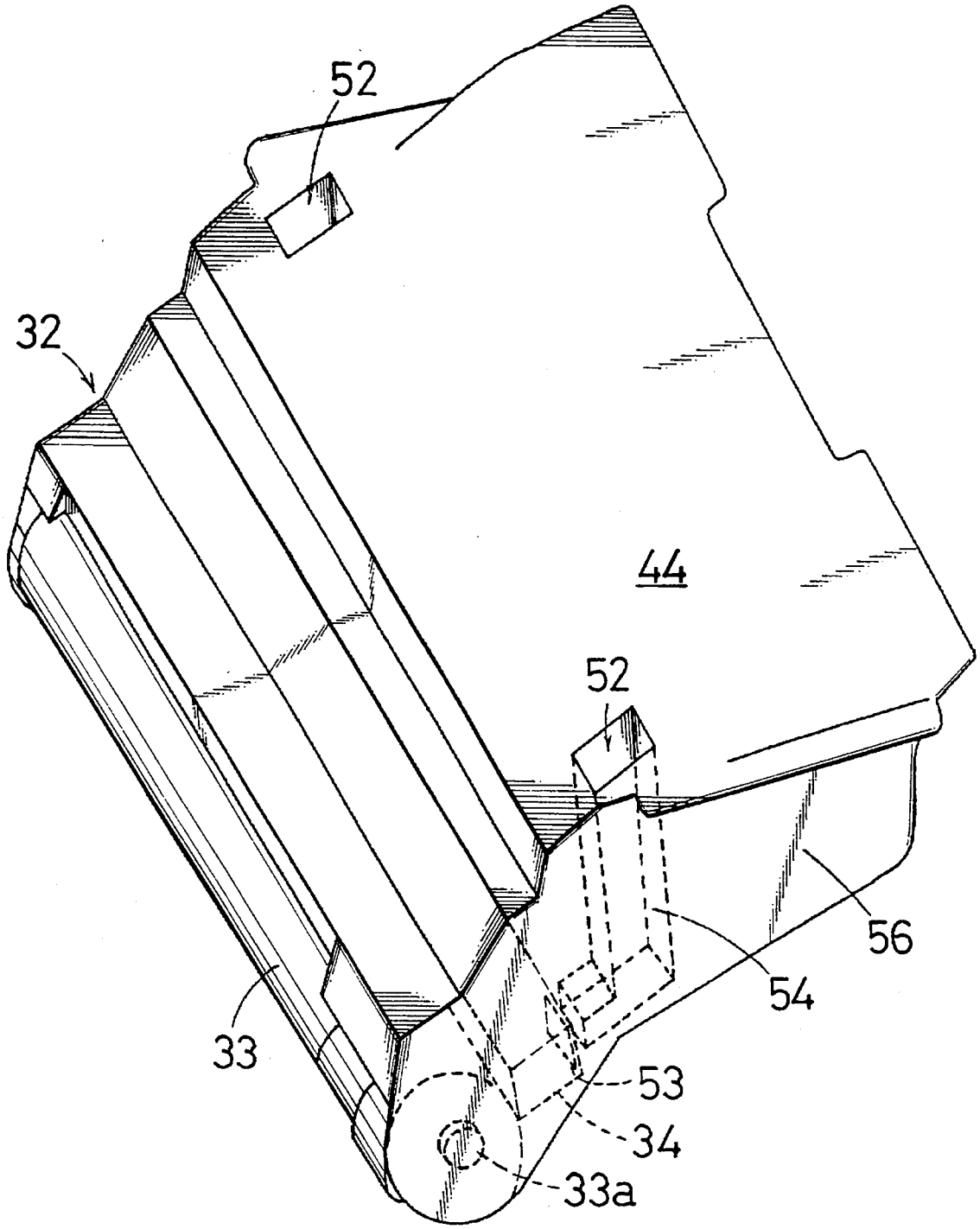
FIG. 4 is a perspective view of a photosensitive cartridge of the embodiment.
Figure 5:
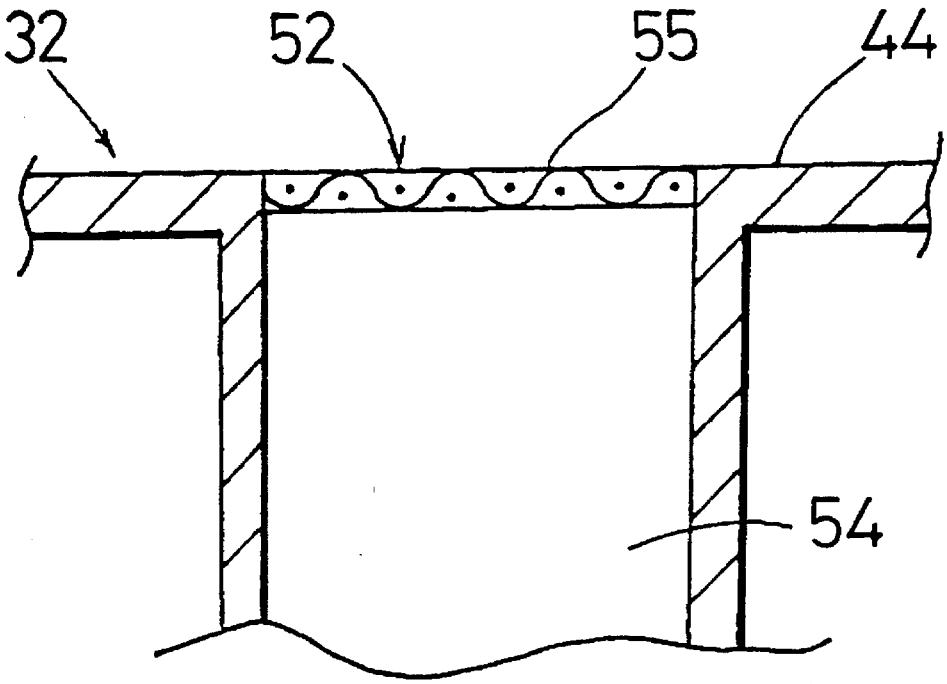
FIG. 5 is an enlarged sectional view of an outside-air intake.
Figure 6:
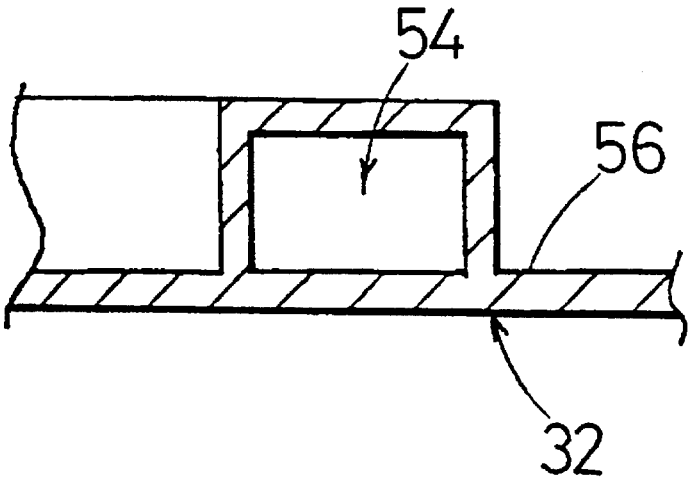
FIG. 6 is a horizontal sectional view of an air passage.
Figure 7:
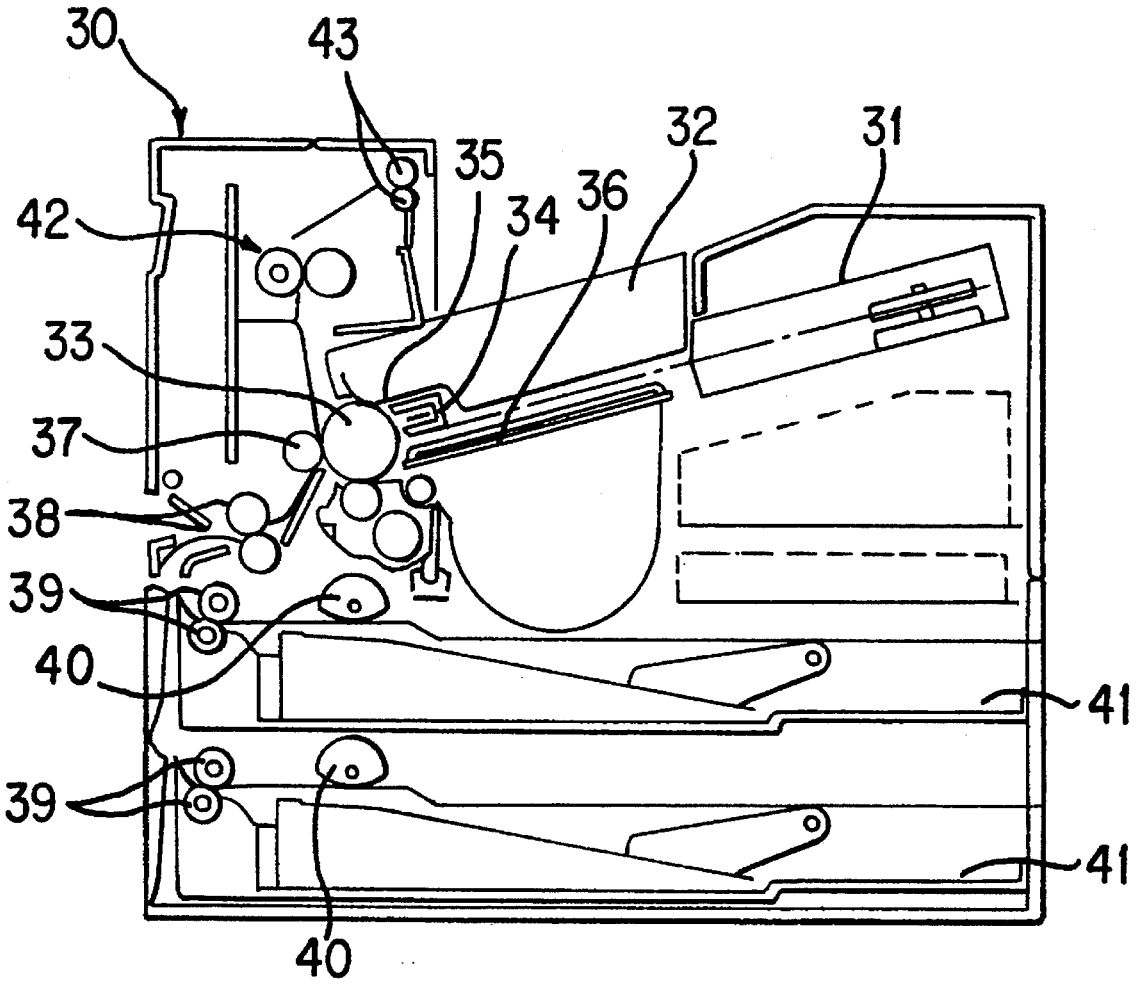
FIG. 7 is a view showing an entire constitution of a laser printer.

FIG. 1 is a view showing a constitution of main parts of an embodiment of a laser printer according to the invention; FIG. 2 is a perspective view of a charger; FIG. 3 is an enlarged sectional view of the charger shown in FIG. 2; FIG. 4 is a perspective view of a photosensitive cartridge of the embodiment; FIG. 5 is an enlarged sectional view of an outside-air intake; FIG. 6 is a horizontal sectional view of an air passage; FIG. 7 is a view showing an entire constitution of a laser printer.

The entire constitution of the embodiment of a laser printer will be described with reference to FIG. 7. In FIG. 7, a printer body 30 comprises an optical unit 31 including a semiconductor laser etc., a photosensitive cartridge 32 integrated with and a photosensitive body 33, a charger 34 and a cleaning device 35, a development cartridge 36, a transfer roller 37, paper stop (PS) rollers 38, sheet carriage rollers 39, a sheet feed roller 40, a sheet feeding cassette 41, a fixing unit 42, and sheet discharge rollers 43. Image forming and sheet feeding processes of a laser printer will not be described in detail, because they are well-known for one of ordinary skill in the art. The PS rollers 38 are arranged in order to synchronize the timing of conveying sheet with that of writing an image on the photosensitive body 33.

The photosensitive cartridge 32, as shown in FIG. 1, is removably attached to the printer body 30 and the top face thereof is exposed to the outside. In the photosensitive cartridge 32, the photosensitive body 33 is installed rotatably via a rotation shaft **33*a* and the charger 34 is arranged so that a front opening 45 thereof is opposed to the photosensitive body 33. Further, the cleaning device 35, behind which a waste toner containing portion 46 is formed, is arranged above the charger 34**.

In the charger 34, as shown in FIGS. 2, 3, a case body 47 is formed to have a U-shaped section and a discharge electrode 48 (charger wire or acicular electrode) providing the surface of the photosensitive body 33 with electrostatic charges is fixed via a holder 49 to the case body 47. Further, to the front opening 45 is fitted a grid member 50 made of thin metal sheet with a mesh structure, in order to equalize the surface potential of the photosensitive body 33. The outside surface of the lower side of the case body 47 is coated with a neoprene foam 51 to absorb the silicone gas for isolating. The neoprene foam is a sheet member with a buffer effect which is made by foaming a neoprene rubber material.

Further, the photosensitive cartridge 32 is provided with outside-air intakes 52 formed on a top face 44 thereof, an air inlet 53 formed on a rear face of the case body 47 of the charger 34, and air passages 54 communicating between the outside-air intake 52 and the air inlet 53.

As shown in FIG. 4, the outside-air intakes 52 are rectangular holes formed on both sides of the longitudinal direction of the top 44 of the photosensitive cartridge 32. The outside-air intakes 52 are positioned apart from the fixing unit 42.

Additionally, as shown in FIG. 5, a filter 55 is installed in the outside-air intake 52 to prevent dusts or the like from entering into the air passage 54 or the like.

The air passages 54 are two ducts which are formed as one body united with the photosensitive cartridge 32 therein by utilizing each of both side walls 56 of the photosensitive cartridge 32 in the longitudinal direction. The air passages 54 are bended to have a L-shaped side as shown in FIG. 1, and formed to have a rectangular section as shown in FIG. 6.

Thereby, an air-flow 57 is formed due to a corona wind rising toward the direction of the photosensitive body 33 on discharging the discharge electrode 48. More specifically, the air is taken in through the outside-air intake 52, flows through the duct 54 and the air inlet 53, and flows out as an air flow 57 through the front opening 45 toward the direction of an arrow shown in FIG. 1.

The fixing unit 42 is provided with a heat roller 58 and a pressure roller 59 arranged to pressurize the heat roller 58. For the heat roller 58 is employed a roller made of Teflon (Teflon is a registered trademark) and a roller made of silicone rubber for the pressure roller. Cleaning roller (cleaning pad) 61 is arranged for the roller 59 in contact therewith and silicone oil is impregnated into the heat roller 58 in order to prevent the heat roller 58 from being contaminated by toner. The surface temperature of the roller 59 is kept high (about 130 to 180°) by using heater lamps 60 arranged for the respective rollers 58, 59 to fix the toner on the sheet.

In the above constitution, the corona discharge is generated by applying a high voltage to the discharge electrode 48 in the charger 34 to provide the surface of the photosensitive body 33 with electrostatic charges and electrify the same. On that occasion, the corona wind rises, due to which the air is taken in through the outside-air intake 52 positioned on the top of the photosensitive cartridge 44, passes through the ducts 54 and the air inlet 53, and flows out through the front opening 45 as an air flow 57. Subsequently, the air flow 57 impacts into the photosensitive body 33 and flows outwards along the surface of the photosensitive body 33 through the charger 34.

A sheet on which a toner image was transferred is conveyed between the heat roller 58 and the pressure roller 59, and the toner is fixed on the sheet due to the heat of the heat roller 58. On that occasion, a silicone gas, which reaches the charger 34 in the photosensitive cartridge 32, is generated by the vaporization of silicone oil due to the heat. The silicone gas, however, does not flow into the charger 34, because the flow direction thereof is changed by the air flow 57.

Thus, since the air flow 57 is formed to flow out through the front opening 45 by restricting air passages into the charger 34 and utilizing the corona wind caused by the corona discharge, the direction of the silicone gas flow out of the fixing unit 42 can be changed to prevent the silicone gas from entering into the charger 34. Additionally, since the outside-air intake 52 is arranged apart from the fixing unit 42, the silicone gas is diffused prior to reaching the outside-air intake 52 to control the inflow of the silicone gas into the charger 34 to the minimum, even when the silicone gas should leak outwards from the laser printer body 30.

Thus, since the siloxane contained in the silicone gas can be prevented from being deposited on the discharge electrode 48, and the abnormal discharge does not occur, it is possible to obtain a high quality of image for a long service period. Moreover, the cleaning interval of the discharge electrode 48 is improved to such an extent that it is enough to clean at intervals of 25,000 to 30,000 sheets in comparison with 10,000 to 15,000 sheets for a prior art.

Further, since the air passage 54 is unitedly formed by utilizing a side wall 56 of the photosensitive cartridge 32, the photosensitive cartridge 32 can be decreased in size and weight, so that a laser printer easy to handle can be provided.

Further, the invention is not limited to the above embodiments and therefore all variations and modifications of the above embodiments within the range of the claims might be within the scope of the invention.

Figure 8:
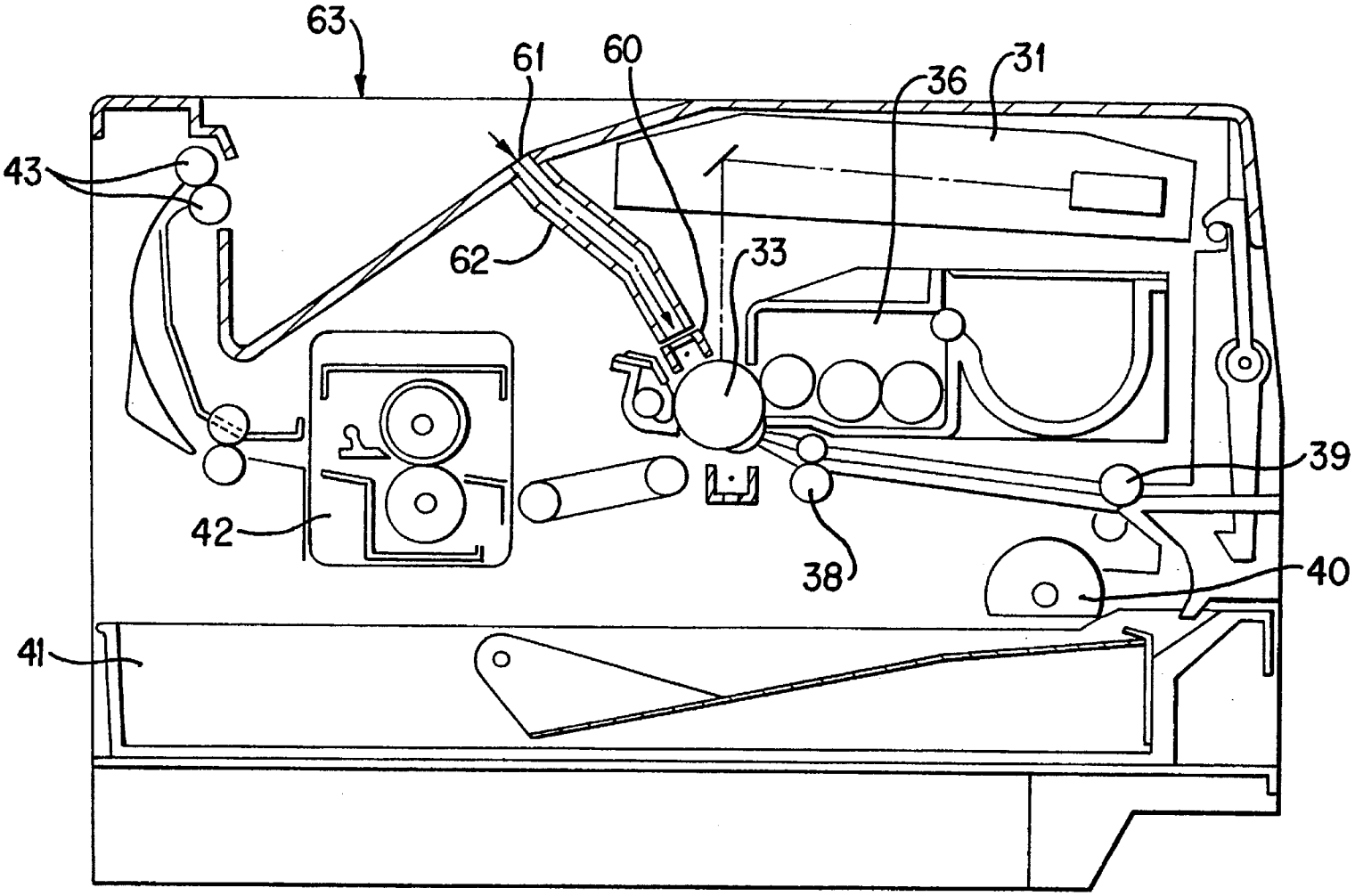
FIG. 8 is a view showing an entire constitution of another embodiment of a laser printer according to the invention.

For example, although the laser printer utilizing the photosensitive cartridge 32 has been described in the above embodiment, the invention may be also applied to a laser printer without the photosensitive cartridge and the air passage 62 communicating between the charger 60 and the outside-air intake 61 may be arranged in the laser printer body, as shown in FIG. 8.

Figure 9:
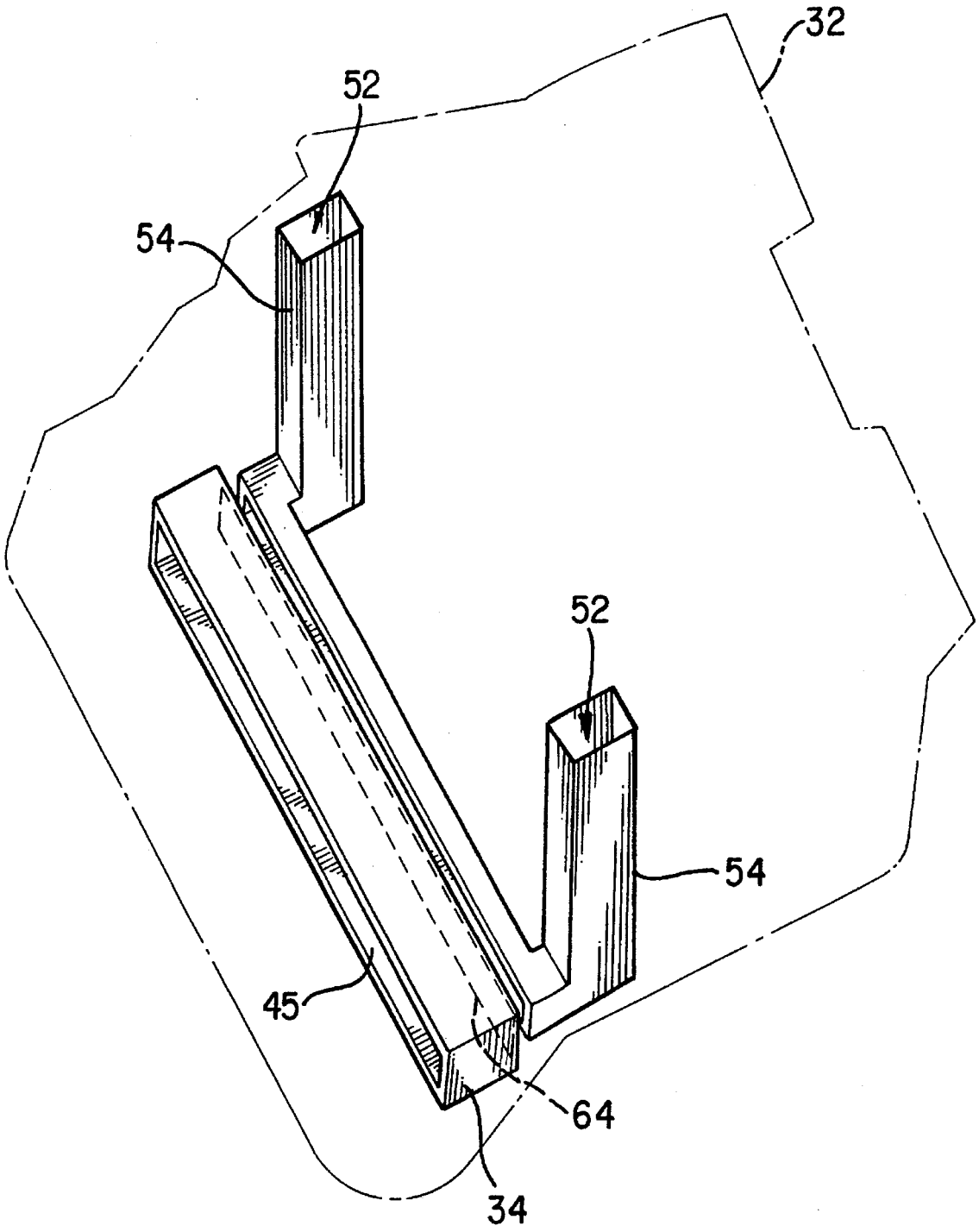
FIG. 9 is a perspective view of a charger and an air passage of another embodiment according to the invention.
Figure 10:
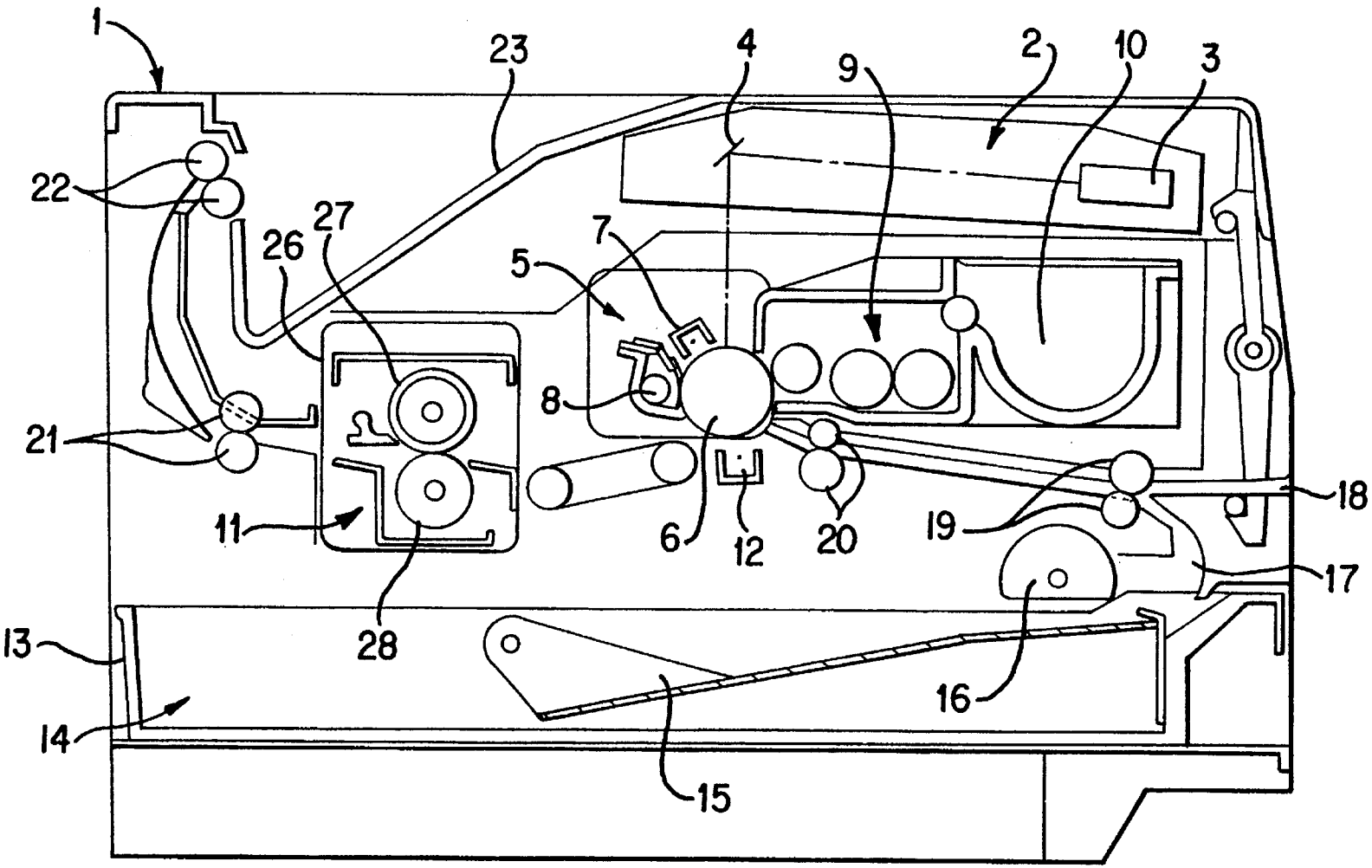
FIG. 10 PRIOR ART
FIG. 10 is a view showing an entire constitution of a conventional laser printer.
Figure 11:
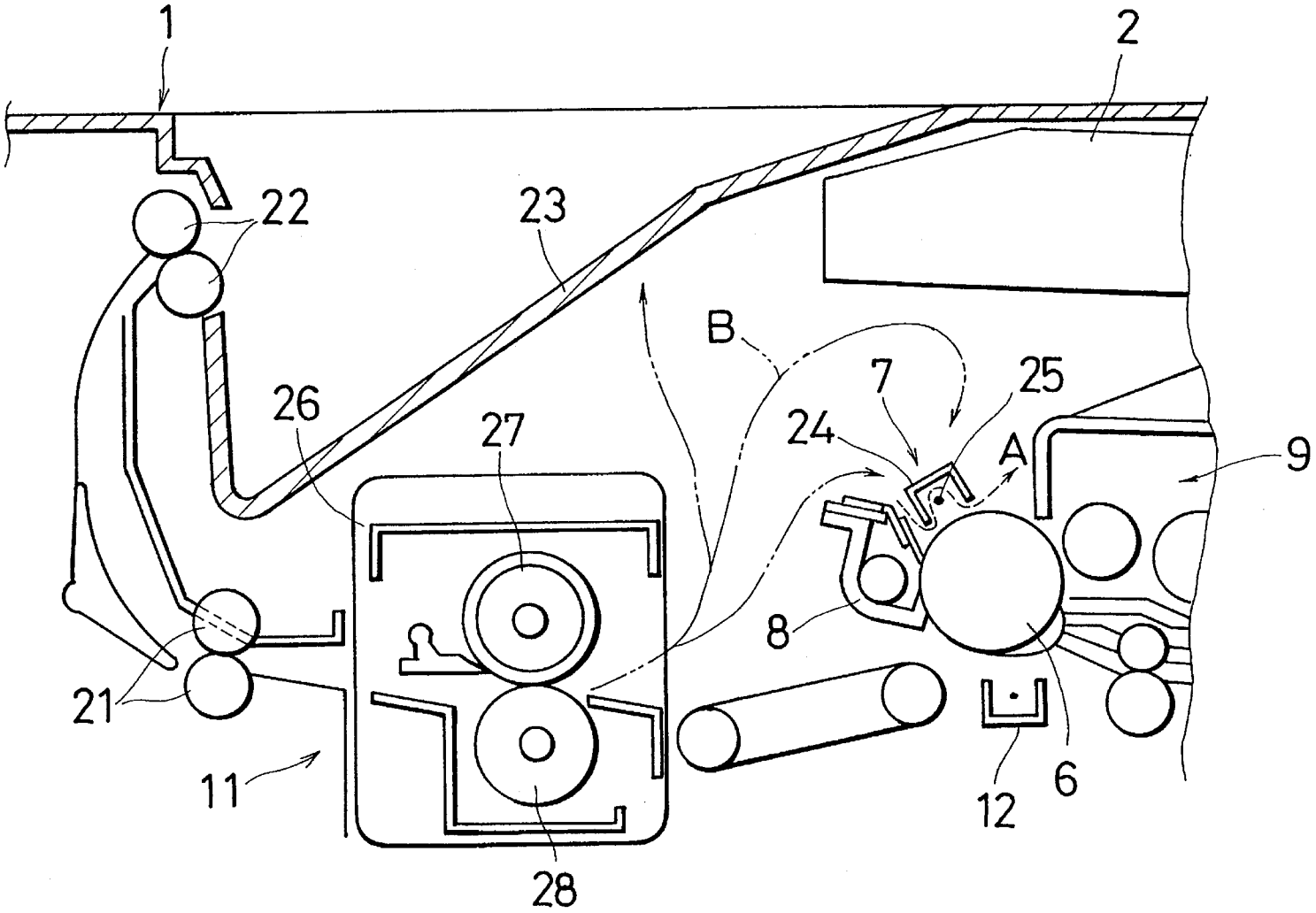
Fig. 11 Prior Art
FIG. 11 is a view showing a silicone gas flow in the conventional laser printer.

Additionally, the form of the air passage 54 in the above embodiment is not limited to L-letter shape. The air passage 54 may be arranged so as to communicate with the air inlet 64 formed in the whole area behind he charger 34 as shown in FIG. 9.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus in a body of which a charger for electrification of a photosensitive body is provided in such arrangement that a front opening of the charger is opposed to the photosensitive body, comprising:

an outside-air intake formed in the image forming apparatus body;

an air inlet formed in the charger; and an air passage communicating between the air inlet and the outside-air intake;

wherein a filter is installed in the outside-air intake; and wherein said air passage comprises two ducts formed as one body united with the image forming apparatus body in such a way that each of said two ducts shares a common sidewall with a respective sidewall of said image forming apparatus body.

2. An image forming apparatus of claim 1, wherein a photosensitive cartridge provided with the photosensitive body and the charger is disconnectably installed in the image forming apparatus body and the air passage is formed in the photosensitive cartridge.

3. An image forming apparatus of claim 2, wherein the air passage is formed by utilizing a side wall of the photosensitive cartridge in a longitudinal direction thereof.

4. An image forming apparatus of claim 2, wherein the outside-air intake is formed on a top face of the photosensitive cartridge.

5. An image forming apparatus of claim 1, wherein the outside-air intake is arranged apart from a fixing unit.

6. An image forming apparatus of claim 4, wherein the outside-air intake is arranged apart from a fixing unit.

7. The apparatus of claim 1, wherein said ducts are L-shaped.

8. The apparatus of claim 1, wherein said air inlet is formed along an entire longitudinal side of said charger.

* * * * *